US009199820B2

(12) United States Patent
Tseng

(10) Patent No.: US 9,199,820 B2
(45) Date of Patent: Dec. 1, 2015

(54) PRODUCE BAG DISPENSER WITH UNISTRUCTURAL BASE AND GUIDES

(71) Applicant: Inteplast Group, Ltd., Livingston, NJ (US)

(72) Inventor: Ben Tseng, Eastbrunswick, NJ (US)

(73) Assignee: Inteplast Group, Ltd., Livingston, NJ (US)

( * ) Notice: Subject to any disclaimer, the term of this patent is extended or adjusted under 35 U.S.C. 154(b) by 258 days.

(21) Appl. No.: 13/998,675

(22) Filed: Nov. 22, 2013

(65) Prior Publication Data

US 2015/0144677 A1 May 28, 2015

(51) Int. Cl.
*B65H 35/10* (2006.01)
*B26F 3/02* (2006.01)

(52) U.S. Cl.
CPC *B65H 35/10* (2013.01); *B26F 3/02* (2013.01); *B65H 2701/191* (2013.01); *Y10T 225/393* (2015.04)

(58) Field of Classification Search
CPC ..... B65H 35/10; B65H 2701/191; B26F 3/02
USPC ..... 225/106
See application file for complete search history.

(56) References Cited

U.S. PATENT DOCUMENTS 1,122,674 A * 12/1914 Winter et al. ..... A47K 10/3818 225/106
3,494,518 A * 2/1970 Goss ..... A47K 10/38 225/34
5,135,146 A * 8/1992 Simhaee ..... B65D 33/002 225/106
5,209,371 A 5/1993 Daniels
5,219,424 A 6/1993 Simhaee
5,307,969 A * 5/1994 Menendez ..... B65H 35/10 225/106
5,433,363 A * 7/1995 Simhaee ..... B65D 33/002 206/390
5,480,084 A 1/1996 Daniels
5,556,019 A * 9/1996 Morris ..... B65D 33/002 225/106
5,558,262 A 9/1996 Simhaee
5,573,168 A * 11/1996 Kannankeril ..... B65H 35/10 225/106
5,706,993 A * 1/1998 DeMatteis ..... B26F 3/002 225/106
5,752,666 A * 5/1998 Simhaee ..... B65D 33/002 206/390
5,813,585 A * 9/1998 Kannankeril ..... A47F 9/0452 225/106
D409,027 S * 5/1999 Simhaee ..... A47F 9/042 D6/518
5,934,535 A * 8/1999 Kannankeril ..... A47F 13/085 225/106
6,135,281 A 10/2000 Simhaee
6,279,806 B1 * 8/2001 Simhaee ..... A47F 9/042 225/106
6,305,572 B1 * 10/2001 Daniels ..... B65D 33/002 206/390
6,431,396 B1 * 8/2002 Daniels ..... B65H 35/10 206/554
6,450,380 B1 * 9/2002 Simhaee ..... A47F 9/042 221/26
6,685,075 B1 * 2/2004 Kannankeril ..... A47F 9/042 225/106
7,128,251 B1 * 10/2006 Galle ..... A47F 9/042 221/45

(Continued)

*Primary Examiner* — Sean Michalski
(74) *Attorney, Agent, or Firm* — Senniger Powers LLP

(57) ABSTRACT

A produce bag dispenser includes a) a uninstructural base frame to receive and nest a plastic produce bag roll, including at least two back sections, a bottom section and a rip tongue, at least one back section at said rearward end having an arcuate shape; b) a set of opposing side guide panels connected for stabilizing the movement of a nested plastic produce bag roll; c) a fixed or adjustable connection mechanism connecting the side guide panels to the base frame; and, d) a plastic produce bag guide bar to create a bag flow space.

10 Claims, 7 Drawing Sheets

(56) References Cited

U.S. PATENT DOCUMENTS 7,270,256 B2 9/2007 Daniels
7,273,193 B2 * 9/2007 Slocum ..... B65H 18/28 242/528
7,424,963 B2 9/2008 Daniels
8,251,270 B2 8/2012 Tseng
8,844,783 B2 * 9/2014 Tan ..... B26F 3/02 225/106
2002/0185513 A1 * 12/2002 Morris ..... B65H 35/10 225/96
2003/0019972 A1 * 1/2003 Goldberg ..... A47K 10/38 242/570
2003/0098326 A1 * 5/2003 Wile ..... A47F 9/042 225/77
2004/0007607 A1 * 1/2004 Daniels ..... A47F 9/042 225/93
2005/0098600 A1 * 5/2005 Yeh ..... B31B 19/94 225/93
2009/0008422 A1 * 1/2009 Daniels ..... B26F 3/02 225/46
2010/0288893 A1 * 11/2010 Tan ..... F16B 47/00 248/205.5
2011/0073629 A1 * 3/2011 Tseng ..... B26F 3/02 225/51
2011/0215128 A1 * 9/2011 Greg ..... B65H 35/00 225/1
2012/0024884 A1 * 2/2012 Wilfong ..... B65H 16/005 221/30
2012/0125970 A1 * 5/2012 Tsui ..... A47F 13/085 225/106
2012/0273543 A1 * 11/2012 Shepherd ..... B65H 35/10 225/106
2012/0305618 A1 * 12/2012 Tan ..... B65H 35/10 225/47
2012/0305619 A1 * 12/2012 Tan ..... B26F 3/02 225/106
2013/0134181 A1 * 5/2013 Helseth ..... B65H 16/005 221/26
2014/0048576 A1 * 2/2014 Tan ..... B65H 35/10 225/51
2014/0166715 A1 * 6/2014 Tan ..... B65H 35/10 225/46
2015/0144677 A1 * 5/2015 Tseng ..... B65H 35/10 225/106

* cited by examiner

PRODUCE BAG DISPENSER WITH UNISTRUCTURAL BASE AND GUIDES

BACKGROUND OF INVENTION a. Field of Invention

The present invention relates generally to dispenser for plastic bags from rolls, and particularly what are referred to as grocery bags and vegetables bags (not limited to use in grocery stores or to be used for groceries, but commonly called plastic grocery bags or produce bags). The present invention dispenser uniquely provides a number of advantages and eliminating some common problems, including: ease of bag separation and removal, automatic threading and guiding of the unripped roll pull, stability of the roll, friction to prevent roll spinning, unistructural base frame with a curved back section and flat section(s) to accommodate brackets, and modular adaptability for attachment to walls, countertops, counter and shelf bottoms, floor and tall stands.

b. Description of Related Art

The following patents are representative of the field pertaining to the present invention:

U.S. Pat. No. 8,251,270 to Ben Tseng describes a plastic bag dispenser with side panels and guide bar that includes: a) a base frame with a back and bottom section with open front adapted to hold a plastic bag roll; b) a swing arm and core rod adapted to receive a plastic bag roll for rotation and to move downwardly as the plastic bag roll is depleted; c) a first and second set of opposing side panels located on the base frame for stabilizing the movement of the plastic bag roll; d) an elongated open guide bar having a top and sides located on the open fronted bottom section for movement of bags from the plastic bag roll; and, e) a rip tongue located on the open fronted bottom section with an upward taper adapted to catch and separate a passing bag when pulled forward through the guide bar and over the rip tongue. Mounting mechanisms for the present invention are also detailed.

U.S. Pat. No. 7,424,963 B2 to Mark E. Daniels describes a wire frame plastic bag dispenser that includes an angled lower bag roll support urging perforated, rolled plastic bags toward a bag roll restraining element attached to the frame. A constraining movement element prevents lateral movement of the bag roll. A perforation parter separates bags as they are pulled from the roll. The bags may be folded along at least one vertical axis to form a more compact bag roll and may have a chisel cut in the perforation to aid in separation by the perforation parter. The frame includes four corners each of approximately 90 degrees, has a C shape in a horizontal plane, and includes a dispensing end, a back end, and two sides. The lower bag roll support includes a proximal end attached to the back end and extends downwardly to a distal end. The perforation parter may be located outwardly from the dispensing end of the frame.

U.S. Pat. No. 7,270,256 B2 to Mark E. Daniels describes a series of roll mounted bags and dispensers. The bags may be folded along at least one axis and rolled. The compact roll of bags is placed in various dispensers. As the upper portion of the first bag is pulled from the roll, the roll will rotate, presenting the succeeding bag for dispensing after the first bag is removed. Variations of the dispenser include one with a bag opening means with a mounting member and bag opening element causing the bags to open as they are pulled from the dispenser. The dispenser includes mechanisms for supporting the bag roll and constraining its movement along its horizontal axis. Another variation of the dispenser has a perforation parting means that facilitates separation of one bag from a subsequent bag. The dispenser may be removably attached to a dispenser support that attaches to a surface.

U.S. Pat. No. 6,135,281 to Ebrahim Simhaee describes a continuous web of bags formed of a plurality of layers to be separated along a line of perforations that extends through all of the layers transverse of the web, in which at least one of the outermost layers is detached from the web at the separation line. Apparatus accomplishes this detachment in a moving web by engaging the outermost layer outer surface and exerting a force in a manner to produce the detachment from the separation line. Both the outermost upper and lower web layers can be detached at the separation line.

U.S. Pat. No. 5,934,535 to Charles Paul Kannankeril et al. describes a bag dispensing system providing plastic bags from a roll of bags where one end is attached to the top of the next bag by perforation lines with a slot there between. The roll of bags provides a core having an indexing member on at least one end. The dispenser comprising a wire frame formed into channels to support the core. The channels include a core retaining member for restraining the core in the channel. The dispenser includes at least one brake attached to a support member and disposed at an angle thereto to provide tension to the edges of the roll of bags as the core passes through the channel passageway as bags are removed from the roll. Spaced apart from the support is a separating tongue. The tongue engages the slot regardless of whether the bags are drawn over or under the tongue.

U.S. Pat. No. 5,752,666 to Ebrahim Simhaee describes a roll of plastic bags for use with a dispenser having opposing tracks in which the roll is supported, and a separating tongue for enabling individual bags to be separated from the roll. The roll of plastic bags is wound on an axle, the plastic bags being in a star sealed configuration. The ends of the axle project beyond the ends of the roll a distance sufficient to enable the axle to be supported for rotational and translational movement in the tracks in such a way that the roll frictionally engages a dispenser surface. Separation lines are provided between adjacent bags, a slot in each separation line being engageable by the tongue within the dispenser so that individual bags can be dispensed from the roll one at a time.

U.S. Pat. No. 5,558,262 to Ebrahim Simhaee describes a plastic bag dispenser that holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user. The roll of bags rests in curved grooves in the dispenser that cause the roll to abut and frictionally engage an interior surface of the dispenser, preventing free-wheeling of the roll. The curvature of the grooves causes the component of force which creates the frictional engagement to increase as the size of the roll decreases.

U.S. Pat. No. 5,556,019 to Joseph W. Morris describes a bag dispenser, for separating and dispensing a series of plastic bags where one end is attached to the top of the next bag by perforation lines with a slot therebetween. The series of bags are dispensed from a device comprising a wire frame formed into channels to support the core that the series of bags are rolled onto. The channels allow the core to rotate in place but restrict its linear movement to the vertical direction. The dispenser has two braking devices, a braking bar underneath the roll of bags and a pair of fingers that are attached to the channels to engage the core. The braking bar is positioned transversely to the series of bags so that it supports them. The pair of fingers does not engage the core until the number of bags on the core has decreased and the core has begun to descend. The two braking devices work in combination to retard the rotation and dispensing of the bags and thus to apply a tension to the series of bags. Attached to the frame is a separator with, preferably, a symmetric projection on its end. The projection will engage the slot regardless of whether the bags are drawn over or under the projection. Additionally, the separator is preferably coiled in its midsection to function as a spring. As the user pulls on the bags, a tension is created by the braking devices and the user to deflect the separator which remains deflected until the projection engages the slot. Thus, when the separator engages the slot, the separator recoils through its normal position to facilitate the separation of the two bags.

U.S. Pat. No. 5,480,084 to Mark E. Daniels describes a rack for dispensing plastic bags from a roll of bags joined end-to-end and separated by a line of perforations and either an opening or a rupturable central area between the bags along the perforation line, comprising a rectangular cradle to hold the roll for removal of bags by unrolling them over a horizontal side element and past a pair of snagging elements which intercept the rupturable central area to restrain each ensuing bag as the preceding bag is pulled away from the roll so as to enable the preceding bag to be separated from the ensuing bag along the perforated and open or rupturable central area line. Provision is made to enable the cradle to be mounted either on or under a store counter, or against a wall.

U.S. Pat. No. 5,219,424 to Ebrahim Simhaee describes a roll of plastic bags wound on an axle which is adapted to be retained within a dispensing device. The bags may be of any configuration but, preferably, are of the type known as a star seal with individual bags separated by perforated separation lines. The bags are wound around a core which can be retained on the axle so that the roll can rotate with respect to the axle when the axle is fixed within the dispensing device. A slot is provided in each separation line between adjacent bags, the slot adapted to engage a complementary tongue in the dispensing device for separating the individual bags. The width of the roll is such relative to the tongue that when an individual bag has been separated from the roll, portions of the next bag on the roll extend forwardly of the tongue where they are in a position to be grasped by a user and subsequently severed from the roll. The roller may include a feature for retarding rotation of the roll of bags relative to the axle.

U.S. Pat. No. 5,209,371 to Mark E. Daniels describes a method and device for dispensing T-shirt type plastic bags from a roll joined end to end in series but separable along perforated lines where the bag ends are connected, whereby the bags are rolled and the roll of bags is placed in a cradle for unrolling and passing between two bars above and parallel to the axis of the roll, at least one of the bars having a centrally disposed hooking snagging element past which the series of bags is drawn. When the open space between the straps of each T-shirt bag passes the snagging element, the latter catches the leading edge of the ensuing bag to restrain it sufficiently so that further pulling on the preceding bag results in its detachment along the perforated line for the ensuing bag. Rack means are provided to enable the method to be practiced.

Notwithstanding the prior art, the present invention is neither taught nor rendered obvious thereby.

SUMMARY OF INVENTION

The present invention is a produce bag dispenser with a uninstructural base and with guides. It includes: a) a uninstructural base frame adapted to receive and nest a plastic produce bag roll, having a forward end and a rearward end, and including at least two back sections, a bottom section and a rip tongue, the at least two back sections having at least one back section at the rearward end having an arcuate shape from a side view, and the rip tongue being located at the forward end and on the bottom section, the rip tongue having an upward taper and adapted to catch and separate a passing plastic produce bag from a nested plastic produce bag roll; b) a set of opposing side guide panels connected to the unistructural base frame and rising upwardly therefrom for stabilizing the movement of a nested plastic produce bag roll; c) a plastic produce bag guide bar having a horizontal portion traversing from one of the opposing side panels to the other of the opposing side panels and located above the unistructural base frame to create a flow space to guide a plastic produce bag roll from a nesting position on the unistructural base frame to the rip tongue.

In some preferred embodiments of the present invention produce bag dispenser with a uninstructural base and with guides, the rip tongue has a triangular shape.

In some preferred embodiments of the present invention produce bag dispenser with a uninstructural base and with guides, the dispenser further includes forward side guards located on opposing sides of the bottom section and adjacent the rip tongue.

In some preferred embodiments of the present invention produce bag dispenser with a uninstructural base and with guides, the uninstructural base frame includes an attachment mechanism for attachment of the opposing side panels thereto.

In some preferred embodiments of the present invention produce bag dispenser with a uninstructural base and with guides, the attachment mechanism is a base bracket and wherein each of the set of opposing side panels includes an inwardly projecting bracket that is attachable to the base bracket.

In some preferred embodiments of the present invention produce bag dispenser with a uninstructural base and with guides, the uninstructural base frame includes a support attachment mechanism for attachment of the dispenser to a separate support member.

In some preferred embodiments of the present invention produce bag dispenser with a uninstructural base and with guides, the dispenser includes a vertical support member attached to the base frame.

In some preferred embodiments of the present invention produce bag dispenser with a uninstructural base and with guides, the set of opposing side panels includes front panels projecting inwardly from each side panel and toward one another.

In some preferred embodiments of the present invention produce bag dispenser with a uninstructural base and with guides, a front guide wire is connected to a front panel.

In other preferred embodiments, the present invention is a produce bag dispenser with a uninstructural base and with guides. It includes: a) a uninstructural base frame adapted to receive and nest a plastic produce bag roll, having a forward end and a rearward end, and including at least two back sections, a bottom section and a rip tongue, said at least two back sections having at least one back section at the rearward end having an arcuate shape from a side view, and the rip tongue being located at the forward end and on the bottom section, the rip tongue having an upward taper and adapted to catch and separate a passing plastic produce bag from a nested plastic produce bag roll; b) a set of opposing side guide panels connected to the unistructural base frame and rising upwardly therefrom for stabilizing the movement of a nested plastic produce bag roll; c) an adjustable connection mechanism connecting the set of opposing side guide panels to the base frame with means to adjust the width between the set of opposing side guide panels to accommodate different width size produce bag rolls; and, d) a plastic produce bag guide bar having a horizontal portion traversing from one of the opposing side panels to the other of the opposing side panels and located above the unistructural base frame to a to create a flow space to guide a plastic produce bag roll from a nesting position on the unistructural base frame to the rip tongue.

In some preferred embodiments of the present invention produce bag dispenser with a uninstructural base and with guides, and with an adjustable connection mechanism, the rip tongue has a triangular shape.

In some preferred embodiments of the present invention produce bag dispenser with a uninstructural base and with guides, and with an adjustable connection mechanism, the dispenser further includes forward side guards located on the sides of opposing bottom section and adjacent the rip tongue.

In some preferred embodiments of the present invention produce bag dispenser with a uninstructural base and with guides, and with an adjustable connection mechanism, the uninstructural base frame includes an attachment mechanism for attachment of the opposing side panels thereto.

In some preferred embodiments of the present invention produce bag dispenser with a uninstructural base and with guides, and with an adjustable connection mechanism, the attachment mechanism is a base bracket and wherein each of the set of opposing side panels includes a bracket that is attachable to the base bracket.

In some preferred embodiments of the present invention produce bag dispenser with a uninstructural base and with guides, and with an adjustable connection mechanism, the uninstructural base frame includes a support attachment mechanism for attachment of the dispenser to a separate support member.

In some preferred embodiments of the present invention produce bag dispenser with a uninstructural base and with guides, and with an adjustable connection mechanism, the dispenser includes a vertical support member attached to the base frame.

In some preferred embodiments of the present invention produce bag dispenser with a uninstructural base and with guides, and with an adjustable connection mechanism, the set of opposing side panels includes front panels projecting inwardly from each side panel and toward one another.

In some preferred embodiments of the present invention produce bag dispenser with a uninstructural base and with guides, and with an adjustable connection mechanism, a front guide wire is connected to a front panel.

In some preferred embodiments of the present invention produce bag dispenser with a uninstructural base and with guides, and with an adjustable connection mechanism, the adjustable connection mechanism includes a sliding component and a locking component.

In some preferred embodiments of the present invention produce bag dispenser with a uninstructural base and with guides, and with an adjustable connection mechanism, locking component is selected from the group consisting of a swing pressure lock mechanism, a locking bolt and nut, a set pin with a plurality of receivers, and a spring lock.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE EMBODIMENTS

Figure 4:
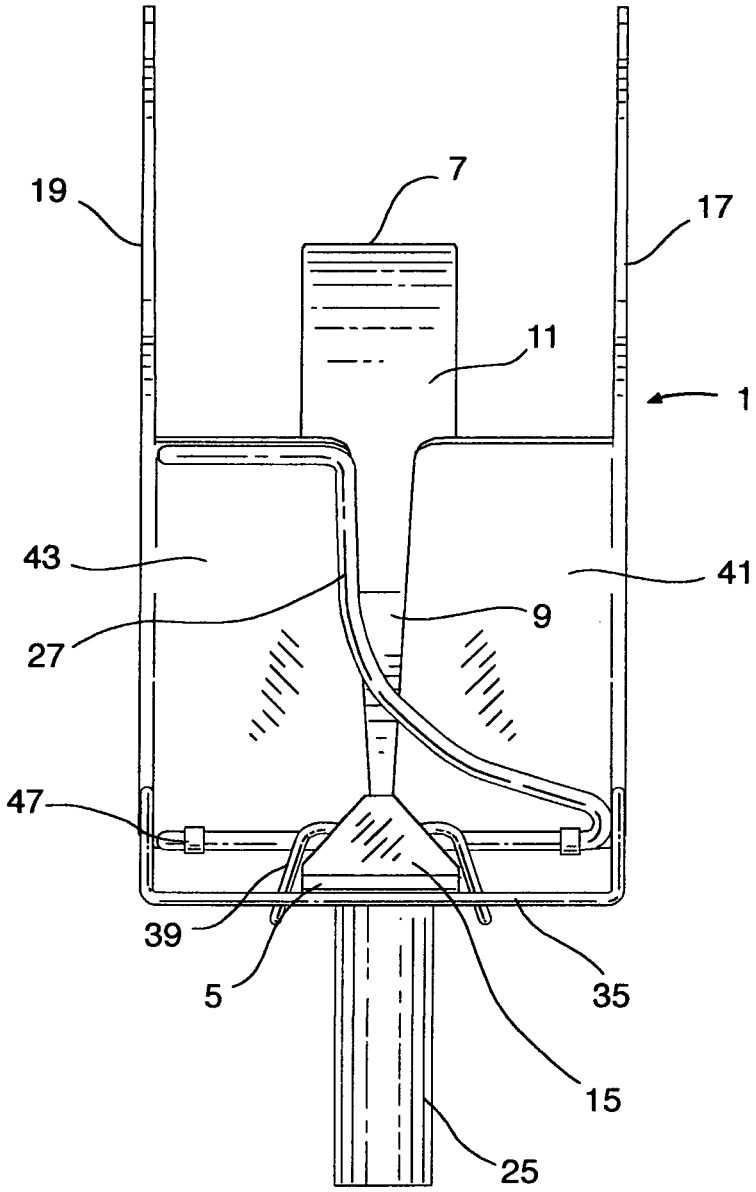
FIG. 4 is a front view of the embodiment of a plastic bag dispenser with a unistructural base and with guides of FIG. 3.
Figure 5:
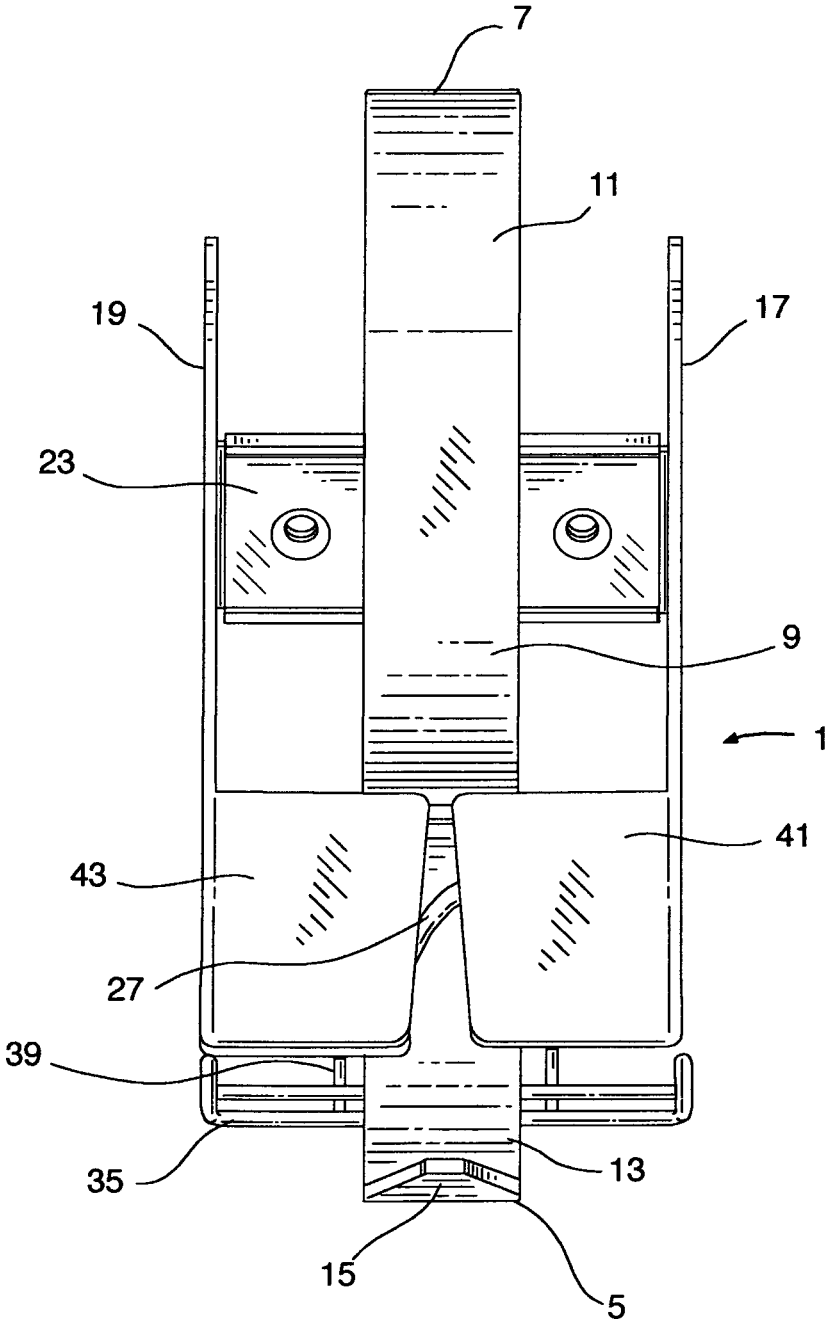
FIG. 5 is a top view of the plastic bag dispenser with a unistructural base and with guides of FIGS. 1, 2, 3 and 4.
Figure 6:
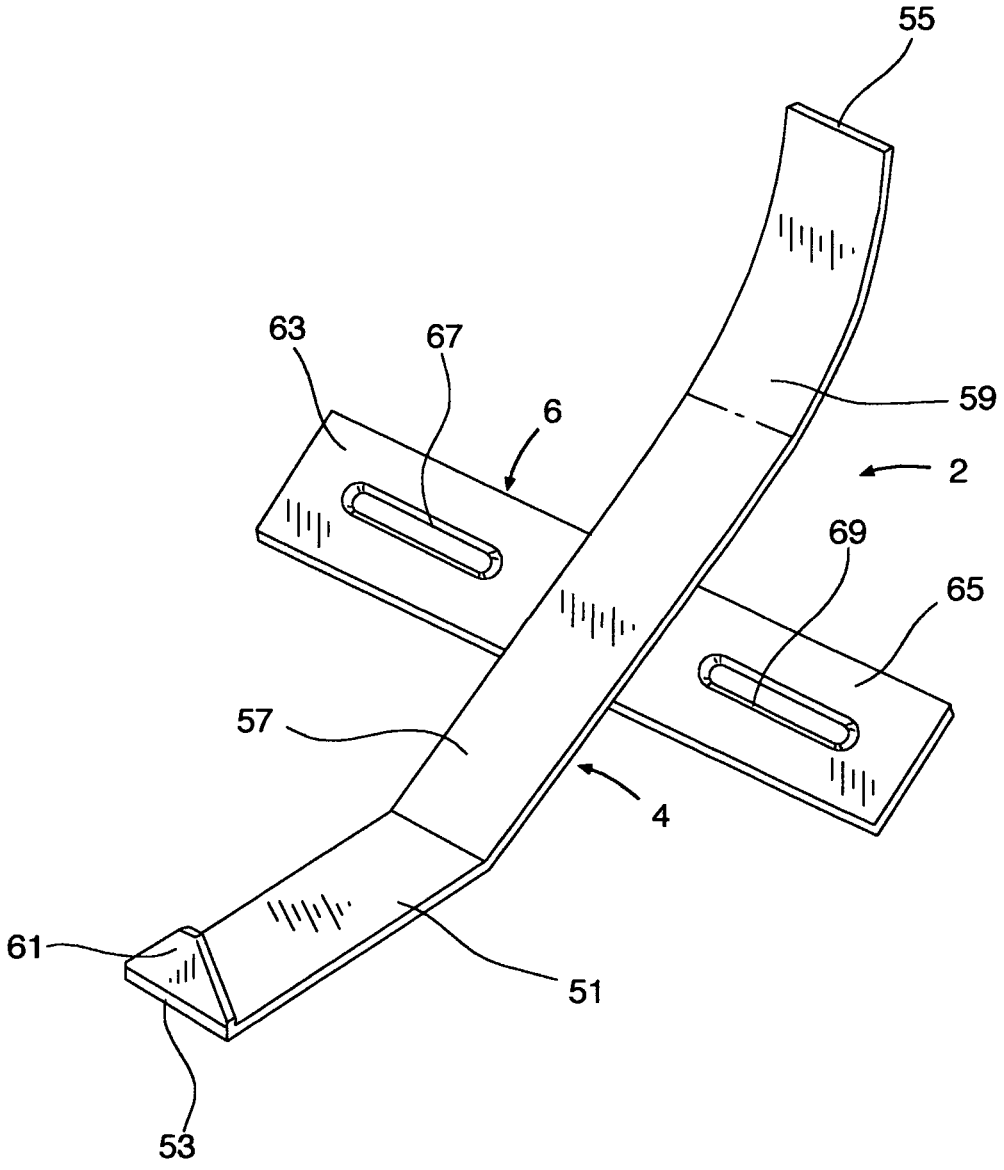
FIG. 6 is a front oblique view of a plastic bag dispenser with a unistructural base and with guides of a different embodiment of the present invention with the side panels and guides removed, showing elongated side panel slots for adjustable width side panels for receiving different width bag rolls.
Figure 7:
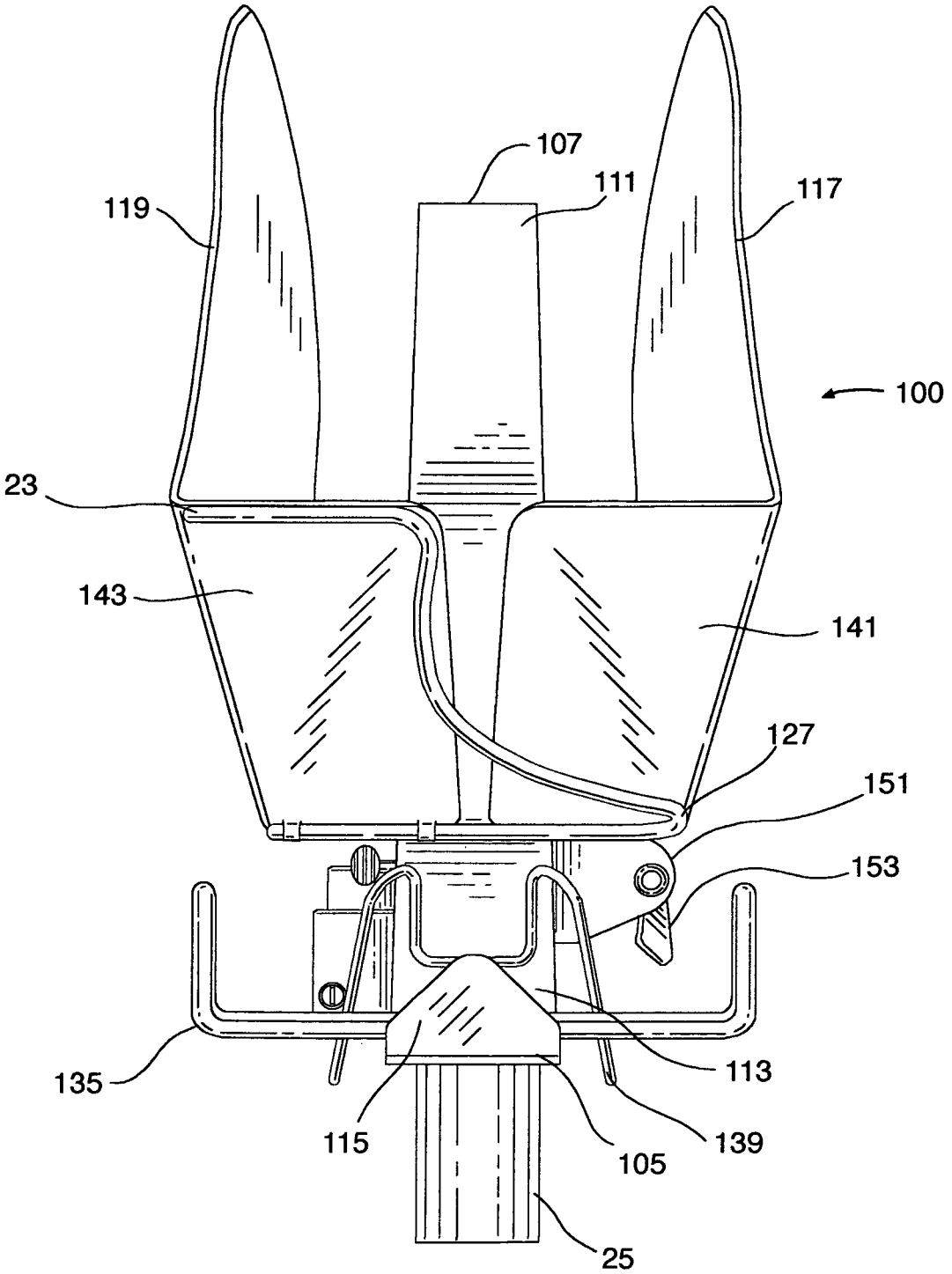
FIG. 7 is a front view of a complete present invention bag dispenser with a unistructural base and guides, having side panel width adjustment means and locking mechanisms.

Referring now to the drawings wherein now like reference numerals designate corresponding parts throughout the several views, as FIG. 1 through FIG. 5 depict various aspects of a single present invention embodiment. FIGS. 6 and 7 address alternative embodiments of the present invention.

Figure 1:
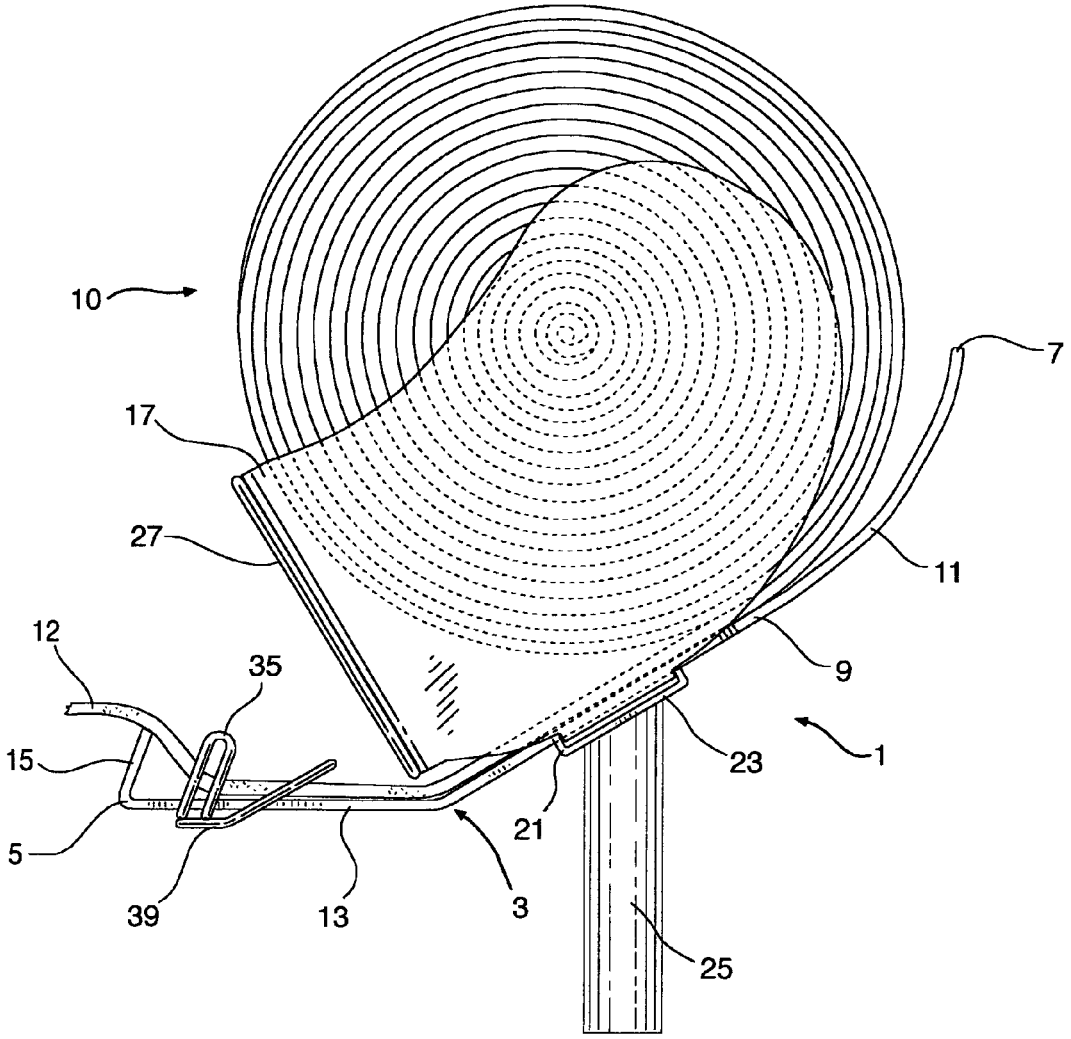
FIG. 1 is a side view of an embodiment of a plastic bag dispenser with a unistructural base and with guides according to the present invention with a plastic bag roll nested in the present invention dispenser.
Figure 2:
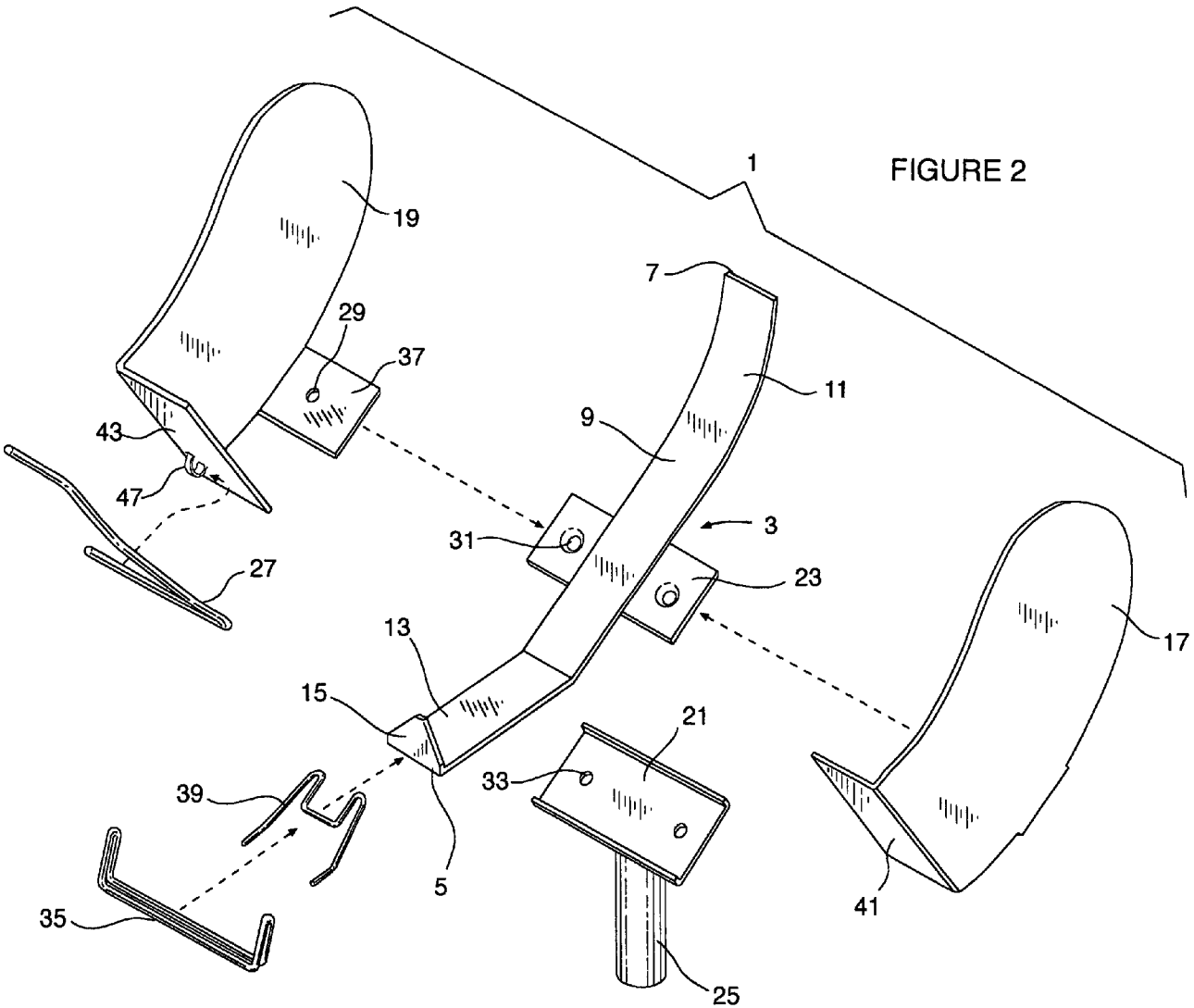
FIG. 2 is an exploded front perspective view of the plastic bag dispenser with a unistructural base and with guides of FIG. 1, showing assembly details.

FIG. 1 is a side view of an embodiment of a present invention plastic bag dispenser 1 with a plastic bag roll 10 nested therein as more fully described below. FIG. 2 is an exploded front perspective view of the plastic bag dispenser 1 of FIG. 1, without bag roll, showing assembly details. FIGS. 1 and 2 are discussed collectively immediately below.

The base frame 3 of the plastic bag dispenser 1 has a forward end 5 and a rearward end 7. Base frame 3 also has two back sections 9 and 11 and bottom section 13. One of the two back sections is curved to accommodate a roll of bags, as shown. In this preferred example, rear-most back section 11 is curved and will create surface to surface friction with bag roll 10. Bottom section 13 has a rip tongue 15 at front end 5. Attachment means 23 is attached to the flat back section 9 and is adapted to attach to receiving bracket 21 of vertical pole 25 at its underside, or to attach to another support, such as a vertical surface mount, a floor stand mount, or a horizontal surface mount, as described below. Attachment means 23 may be temporarily or permanently connected to the support (e.g. pole) receiving bracket. For example, they could be welded or lock bolted, or removeably attached thereto, e.g. with spring washer/bolt or quick swing release connectors. Additionally, attachment means 21 is a receiving bracket for the inwardly projecting side panel brackets, such as orificed bottom brackets. In this embodiment, the side panels 17 and 19 have bottom connecting brackets, such as bracket 37. Side panel 17 has a similar inwardly projecting bracket which is hidden from view but is the mirror image of bracket 37.

The pair of opposing side panels 17 and 19 (of FIG. 2) are mounted to back section 9 of the base frame 3 to stabilize the movement of a nested plastic bag roll 10. In this embodiment, the set of opposing side panels 17 and 19 project forwardly at right angles on opposite sides of back section 9. Also, in this embodiment, the set of opposing side panels 17 and 19 project significantly upwardly and forwardly at right angles on opposite sides of bottom section 9 and they have inwardly projecting front panels 41 and 43, that act as bag roll brakes.

An open, bag guide bar 39 for movement of plastic bag 12 from the nested plastic bag roll 10 is located toward the open front end 5 of the bottom section 13 of base frame 3. Bag guide bar 39 is adapted to assist in the desired movement of plastic bag 12 from the plastic bag roll 10. In the present embodiment, bag guide bar 39 is a stiff wire complex arch (here "M" shaped) that connects with cross-locking base wire guide 35 located on the bottom section 13 of base frame 3 and oriented perpendicularly therefrom. Base wire guide 35 also acts as a side guard on bottom section 13 to maintain proper alignment of plastic bag 12 over the rip tongue 15 during dispensing.

Rip tongue 15 is located at the open front end 5 of bottom section 13 and is transverse to bottom section 13. Rip tongue 15 is adapted to catch and separate a passing bag 12 from a nested plastic bag roll 10. Front wire 27 connects side panels 17 and 19 at their front panels 41 and 43. Wire 27 may be connected by flanges, e.g. flange 47 on front panel 43 and may also set as a guide for containment of moving bags behind guide bar 39.

It can be seen in FIG. 2 that assembly orifices, such as orifice 29 in bracket 37 of side panel 19, orifice 31 in attachment means 23 and orifice 33 in receiving bracket 21, are used for assemblage with metal screws, bolts and nuts or other fasteners. Bag guide bar 39 and base wire guide 35 are assembled together, as shown.

To operate the present invention plastic bag dispenser, a plastic bag 12 is pulled down over the rip tongue 5. This causes nested plastic bag roll 10 to unroll until perforations in plastic bag 12 pass over the rip tongue 5. As the perforations pass over rip tongue 5 and the perforations and/or a central hole between bags catch on the rip tongue 5, the plastic bag 12 separates from the nested plastic bag roll 10 across the perforations. The next plastic bag on the nested plastic bag roll 10 is then positioned in the open front end 5 for subsequent removal and use. The plastic bag roll 10 is prevented from unraveling when not in use by friction between the plastic bag roll 10 and the back sections 9 and 11 of base frame 3 and between the bag roll 10 and the front panels 41 and 43.

Figure 3:
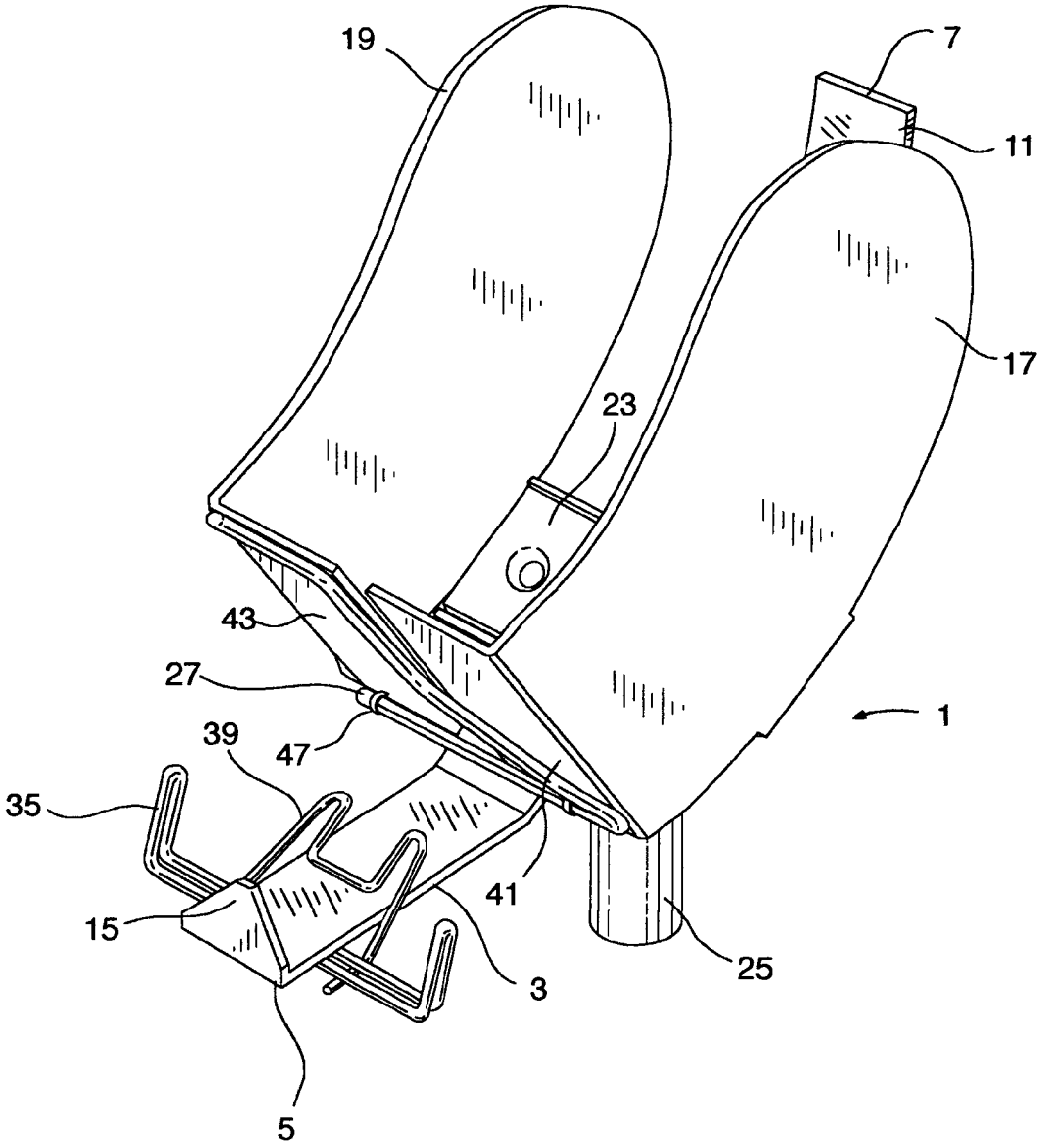
FIG. 3 is a perspective view of an embodiment of a plastic bag dispenser with a unistructural base and with guides, of FIGS. 1 and 2, assembled and without a nested plastic bag roll on the base frame.

FIG. 3 is a perspective view of the embodiment of a plastic bag dispenser 1 of FIGS. 1 and 2, assembled and without nested plastic bag roll 10 on the base frame. FIG. 4 is a front view of the embodiment of a plastic bag dispenser 1 of FIG. 3. FIG. 5 is a top view of the plastic bag dispenser 1 of FIGS. 1, 2, 3 and 4. Identical parts are identically numbered throughout these Figures.

FIG. 6 is a front oblique view of a different present invention plastic bag dispenser 2, shown with its panels and guides removed to more fully illustrate adjustable width side panel capabilities. In this embodiment, the unistructural base 4 has two back sections 57 and 59 and bottom section 51. Back section 59 is curved to accommodate a roll of bags, including increased frictional bag contact and more steady gravity-based support. Bottom section 51 has a rip tongue 61 at its front end 53. Attachment means 6 is attached to the flat back section 57 and is adapted to attach to receiving brackets of vertical poles at its underside, or to attach to other supports, such as a vertical surface mount, a floor stand mount, or a horizontal surface mount, as described below. Attachment means 6 is permanently connected to flat back section 57 and it may be temporarily or permanently connected to one or more supports (not shown), such as poles or wall mounts, and they could be welded or lock bolted, or removeably attached thereto, e.g. with spring washer/bolt or quick swing release connectors. Additionally, attachment means 6 is a receiving bracket for the inwardly projecting side panel brackets, such as side panel bracket 37 FIG. 2, as shown above.

Because the attachment orifices 67 on left side 63 and 69 on right side of 65 attachment means 6 are elongated at right angles to the side panels, side panels may be positioned with their attachment bracket orifices positioned anywhere along each of orifices 67 and 69 to vary the space between them to accommodate different width bags. For example, elongated orifice option may accommodate side panel spacings of 2 to 6 inches, or any other range that a manufacturer may desire.

FIG. 7 is a front view of a complete present invention bag dispenser 100 with a unistructural base and guides, having side panel width adjustment means and locking mechanisms, as follows:

The present invention bag dispenser 100 base frame has a forward end 105 and a rearward end 107. The base frame also has two back sections (one hidden) one curved back section 111 and bottom section 113. One of the two back sections is curved to accommodate a roll of bags, as shown. Here, rearmost back section 111 is curved and will create surface to surface friction with a bag roll. Bottom section 113 has a rip tongue 115 at front end 105. Attachment means 151 is attached to the flat back section and is adapted to attach to a receiving bracket of a support, e.g. a vertical pole 25 at its underside. Additionally, attachment means 151 is a receiving bracket for the inwardly projecting side panel brackets, such as described above, e.g. bracket 37 (of FIG. 2). However, elongated orifices (such as described in FIG. 6 above) allow for transaxial sliding of the side panels 117 and 119 to adjust to different width bad rolls. However, instead of the FIG. 6 function, wherein the fasteners are untightened, the side panels slid in or out and then the fasteners are tightened; this embodiment in FIG. 7 utilizes a quick release mechanism in the alternative.

Thus, instead of tight fasteners, sliding fasteners are used with the side panels and the elongated orifices of attachment means 151. A separate locking mechanism pressure locks and unlocks the side panels 117 and 119. Swing arm 153 is pushed up to release and slide side panels 117 and 119 for spacing adjustment and pushes down to lock their positions.

The pair of opposing side panels 117 and 119 (of FIG. 7) are mounted to back section 9 of the base frame 3 to stabilize the movement of a nested plastic bag roll 10.

Other features are similar to those described above: An open, bag guide bar 139 for movement of plastic bags from the nested plastic bag roll is located toward the open front end 105 of the bottom section 113 of base frame. Bag guide bar 139 is adapted to assist in the desired movement of plastic bags from the plastic bag roll. Bag guide bar 139 is a stiff wire complex arch (here "M" shaped) that connects with cross-locking base wire guide 135 located on the bottom section 113 of the base frame and oriented perpendicularly therefrom. Base wire guide 135 also acts as a side guard on bottom section 113 to maintain proper alignment of plastic bags over the rip tongue 115 during dispensing.

Rip tongue 115 is located at the open front end 105 of bottom section 113 and is transverse to bottom section 113. Rip tongue 115 is adapted to catch and separate a passing bag from a nested plastic bag roll. Side panels 117 and 119 and the front panels 141 and 143 are positioned and connected as shown. Front wire 127 is connected to panel 143. Wire 127 may be connected by flanges, on front panel 143, and may also serve as a guide for containment of moving bags behind guide bar 139.

Other than the quick release adjustment described, this dispenser 100 operates in the same fashion as the earlier described present invention dispensers.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. While being shown for floor stand use, it should be understood that the present invention can be used in any environment and position, such as a table mount, wall mount or any other orientation useful for functionality of the present invention dispenser.

What is claimed is:

1. A produce bag dispenser with a uninstructural base and with guides, which comprises:

a) a uninstructural base frame adapted to receive a bag roll, having a forward end and a rearward end, and including a bottom section and a rip tongue, and said rip tongue being located at said forward end and on said bottom section, said rip tongue being bent up from said bottom section and having an upward taper and adapted to catch and separate a passing bag from a bag roll;

b) a set of opposing side guide panels including front panels projecting inwardly from each side panel and toward one another connected to said unistructural base frame and rising upwardly therefrom for stabilizing the movement of a bag roll, said front panels terminating without contacting each other, and forming a gap therebetween, at least one front panel contacted by a front wire;

c) an adjustable connection mechanism connecting each one of said set of opposing side guide panels to said base frame with means to adjust the position of said panels on said base frame and the width between the set of opposing side guide panels to accommodate different width size produce bag rolls; and, d) a bag guide bar formed from a bent wire and fixedly mounted to said unistructural base frame between said front panels and said rip tongue, said guide bar having a horizontal portion traversing said gap formed between said front panels when viewed from the front, and said guide bar located above said unistructural base frame to create a gap between the horizontal portion and the base frame at a height below said front wire to guide a plastic produce bag roll from a nesting position on said unistructural base frame to said rip tongue in a path beneath said front wire, beneath said front panels and between said guide bar and said unistructural base frame.

2. The produce bag dispenser with a uninstructural base and with guides of claim 1 wherein said rip tongue has a triangular shape.

3. The produce bag dispenser with a uninstructural base and with guides of claim 1 wherein said dispenser further includes forward side guards located on opposing sides of said bottom section and adjacent said rip tongue.

4. The produce bag dispenser with a uninstructural base and with guides of claim 1 wherein said uninstructural base frame includes an attachment mechanism for attachment of said opposing side panels thereto.

5. The produce bag dispenser with a uninstructural base and with guides of claim 4 wherein said attachment mechanism is a base bracket and wherein each of said set of opposing side panels includes an inwardly projecting bracket that is attachable to said base bracket.

6. The produce bag dispenser with a uninstructural base and with guides of claim 1 wherein said uninstructural base frame includes a support attachment mechanism for attachment of said dispenser to a separate support member.

7. The produce bag dispenser with a uninstructural base and with guides of claim 1 wherein said dispenser includes a vertical support member attached to said base frame.

8. The produce bag dispenser with a uninstructural base and with guides of claim 1 wherein said front wire is a front guide wire connected to one of said front panels.

9. The produce bag dispenser with a uninstructural base and with guides of claim 1 wherein said adjustable connection mechanism includes a sliding component and a locking component.

10. The produce bag dispenser with a uninstructural base and with guides of claim 9 wherein said locking component is selected from the group consisting of a swing pressure lock mechanism, a locking bolt and nut, a set pin with a plurality of receivers, and a spring lock.

* * * * *